US005203355A

United States Patent [19]

Clearman et al.

[11] Patent Number: 5,203,355

[45] Date of Patent: Apr. 20, 1993

[54] CIGARETTE WITH CELLULOSIC SUBSTRATE

[75] Inventors: Jack F. Clearman, Blakely, Ga.; Billy T. Conner, Winston-Salem; Ronnie G. Huff, Kernersville, both of N.C.

[73] Assignee: R. J. Reynolds Tobacco Company, Winston-Salem, N.C.

[21] Appl. No.: 655,706

[22] Filed: Feb. 14, 1991

[51] Int. Cl.[5] ..... A24B 15/00

[52] U.S. Cl. ..... 131/359; 131/336; 131/194; 131/339

[58] Field of Search ..... 131/359, 335, 194, 336, 131/297, 339, 365

[56] References Cited

U.S. PATENT DOCUMENTS

| | | | |
|---|---|---|---|
| 3,885,574 | 5/1975 | Borthwick et al. | 131/359 |
| 3,931,824 | 1/1976 | Miano et al. | 131/359 |
| 4,008,723 | 2/1977 | Borthwick et al. | 131/359 |
| 4,347,855 | 9/1982 | Lanzillotti et al. | 131/360 |
| 4,506,682 | 3/1985 | Muller . | |
| 4,708,151 | 11/1987 | Shelar . | |
| 4,714,082 | 12/1987 | Banerjee et al. | 131/365 |
| 4,732,168 | 3/1988 | Resce et al. . | |
| 4,756,318 | 7/1988 | Clearman et al. | 131/359 |
| 4,779,631 | 10/1988 | Durocher et al. | 131/365 |
| 4,782,644 | 11/1988 | Haarer et al. . | |
| 4,793,365 | 12/1988 | Sensabaugh, Jr. et al. | 131/359 |
| 4,802,568 | 2/1989 | Haarer et al. . | |
| 4,807,809 | 2/1989 | Pryor et al. | 131/339 |
| 4,821,749 | 4/1989 | Toft et al. | 131/297 |
| 4,827,950 | 5/1989 | Banerjee et al. . | |
| 4,854,331 | 8/1989 | Banerjee et al. . | |
| 4,858,630 | 8/1989 | Banerjee et al. . | |
| 4,870,748 | 10/1989 | Hensgen et al. . | |
| 4,881,556 | 11/1989 | Clearman et al. . | |
| 4,893,637 | 1/1990 | Hancock et al. . | |
| 4,893,639 | 1/1990 | White . | |
| 4,903,714 | 2/1990 | Barnes et al. | 131/194 |
| 4,917,128 | 4/1990 | Clearman et al. . | |
| 4,924,883 | 5/1990 | Perfetti et al. | 131/336 |
| 4,928,714 | 5/1990 | Shannon . | |
| 4,938,238 | 7/1990 | Barnes et al. . | |
| 4,981,522 | 1/1991 | Nichols et al. | 131/359 |
| 4,986,286 | 1/1991 | Roberts et al. | 131/297 |
| 4,989,619 | 2/1991 | Clearman et al. | 131/359 |
| 4,991,596 | 2/1991 | Lawrence et al. | 131/194 |
| 5,027,836 | 7/1991 | Shannon et al. | 131/359 |

FOREIGN PATENT DOCUMENTS

| | | |
|---|---|---|
| 236992 | 9/1987 | European Pat. Off. . |
| 304766 | 3/1989 | European Pat. Off. . |
| 326370 | 8/1989 | European Pat. Off. . |
| 338831 | 10/1989 | European Pat. Off. . |
| 342538 | 11/1989 | European Pat. Off. . |

OTHER PUBLICATIONS

Chemical and Biological Studies New Cigarette Prototypes that Heat Instead of Burn Tobacco, R. J. Reynolds Tobacco Company 1988.

Leffingwell et al., Tobacco Flavoring For Smoking Products (1972).

Sittig, Tobacco Substitutes, Noyes Data Corp. (1976).

*Primary Examiner*—V. Millin

*Assistant Examiner*—Lynne A. Reichard

*Attorney, Agent, or Firm*—Grover M. Myers; David G. Conlin

[57] ABSTRACT

The present invention provides improved cigarettes and other smoking articles in which the substrate is a cellulosic material, preferably paper or a paper-like material, e.g., tobacco paper. The substrate of the present invention is used to retain flavorants and the aerosol forming materials, which upon exposure to heated air passing through the aerosol generating means during smoking, are vaporized and delivered to the user as a smoke-like aerosol.

16 Claims, 2 Drawing Sheets

CIGARETTE WITH CELLULOSIC SUBSTRATE

BACKGROUND OF THE INVENTION

The present invention rleates to smoking articles such as cigarettes, and in particular, to those smoking articles having a short fuel element and a physically separate aerosol generating means. Smoking articles of this type, and methods and apparatus for preparing them are described in the following patents; U.S. Pat. Nos. 4,708,151 to Shelar; 4,714,082, Banerjee et al.; 4,732,168, Resce; 4,756,318, Clearman et al.; 4,782,644, Haarer et al.; 4,793,365, Sensabaugh; 4,802,568, Haarer et al.; 4,827,950, Banerjee et al.; 4,854,331, Banerjee et al.; 4,858,630, Banerjee et al.; 4,870,748, Hensgen et al.; 4,881,556, Clearman et al.; 4,893,637, Hancock et al.; 4,893,639, White; 4,903,714, Barnes et al.; 4,917,128, Clearman et al.; 4,928,714, Shannon and 4,938,238, Barnes et al., and in *Chemical and Biological Studies New Cigarette Prototypes That Heat Instead Of Burn Tobacco*, R. J. Reynolds Tobacco Company, 1988. These smoking articles are capable of providing the smoker with the pleasures of smoking (e.g., smoking taste, feel, satisfaction, and the like).

Cigarettes, cigars and pipes are popular smoking articles which use tobacco in various forms. As discussed in the background sections of the aforementioned patents, many smoking articles have been proposed as improvements upon, or alternatives to, the various popular smoking articles.

Smoking articles described in the aforesaid patents and/or publications employ a combustible fuel element for heat generation and aerosol forming substances positioned physically separate from, and in a heat exchange relationship with, the fuel element. The aerosol generating means normally includes tobacco in various forms such as densified pellets, tobacco dust and tobacco extracts, as well as tobacco flavor modifiers and tobacco flavoring agents and aerosol forming substances such as glycerin. During smoking, heat generated by the fuel element acts to volatilize the aerosol forming substances, thereby providing an aerosol which resembles tobacco smoke. Such smoking articles yield extremely low levels of visible sidestream smoke as well as low levels of FTC "tar".

Many of the aforementioned smoking articles employ a substrate as a carrier for the aerosol forming substance in the aerosol generating means. Typically these substrates have been noncombustible solids, e.g., graphite, carbon, alumina, and the like, which are deemed heat-stable under the operating conditions of the smoking articles using them. In such articles the substrate was exposed to temperatures in the range of 400°–800° C., necessitating a heat-stable material.

SUMMARY OF THE INVENTION

The present invention provides improved cigarettes and other smoking articles employing short fuel elements and physically separate aerosol generating means in which the substrate has a controlled evaporative surface area. The controlled evaporative surface area helps to regulate the rate of aerosol production, the amount of aerosol delivered per puff, and determines the heat output requirements of the fuel element for total delivery of aerosol during smoking.

The substrates of the present invention likewise permit control over the amount of aerosol generated regardless of the range of fuel element temperatures. For example, the fuel element may have a variable temperature profile over its 10–12 puff life, and the substrates of the present invention ensure that adequate aerosol will be produced at the lowest temperature point, while preventing over production of aerosol at the highest temperature point.

It has been discovered that substrates of the present invention provide substantially improved ability to control the total heat requirements of the smoking articles. The substrates of the present invention all have a low mass. Low mass substrates have a low heat capacity and do not require large amounts of heat to bring them up to operating temperatures. Substantially all of the heat put into the substrate by the fuel element is given off by the substrate through conduction, convection, radiation, and/or evaporation. As the substrate temperature rises, its rate of heat loss increases, the result being a system where the heat out essentially equals the heat in, at any desired substrate temperature. A low mass substrate is capable of giving off a high portion of its heat through evaporation. Total control of the heat requirements of the cigarette is thus available.

The low mass substrates of the present invention have the ability of absorbing an amount of aerosol forming material in multiples of their own weight. Preferred substrates can carry from about 1 to 4 times their dry weight in aerosol forming materials. Typical low mass substrates of the present invention have a mass of from about 20 to 100 mg, preferably from about 30 to 60 mg and most preferably from about 35 to 45 mg.

The low mass substrates of the present invention are cellulosic materials, that is, they primarily comprise cellulose. Additives and fillers may be included in the substrate if desired so long as at least 50% of the material therein is cellulose. Preferred cellulosic materials used as substrates herein are wicking papers or paper-like materials, in the forms of sheets, webs, strands, filaments, strips, and the like. One preferred paper substrate of the present invention has the form of a non-woven, sheet-like paper material. This substrate typically is provided as a cylindrical segment in the form of a gathered web, within a circumscribing outer wrapper.

Preferred substrates of the present invention have at least two segments; a first segment comprising a small evaporative surface which is exposed to the hot gases from the fuel element and a second, remote segment of wicking paper which serves as a reservoir for the aerosol forming materials. The evaporative surface area of the substrates typically ranges from about 5 $mm^2$ to about 30 $mm^2$, preferably from about 7 $mm^2$ to about 20 $mm^2$, and most preferably from about 9 $mm^2$ to about 15 $mm^2$.

It has been found that the wicking characteristics of the substrates of the present invention allow the aerosol forming materials (and other ingredients) to migrate to the evaporative surface in the same proportion as originally applied to the substrate. This ensures delivery of flavors in a constant and predictable manner, allowing for the pre-selection of flavor characteristics of the cigarette, e.g., light, medium, or heavy, while delivering a constant amount of aerosol per puff.

The substrates of the present invention retain aerosol forming materials and other ingredients, e.g., flavorants and the like, which upon exposure to heated gases passing through the aerosol generating means during puffing, are vaporized and delivered to the user as a smoke-like aerosol. As described above, the aerosol forming material loading on the substrates of the present invention is at least about 100% by weight. Preferred aerosol forming materials used herein include glycerin, water, and the like, flavorants, and other optional ingredients.

The substrates of the present invention are typically carried in a sleeve which contacts the rear periphery of the fuel element. The sleeve channels the hot gases.from the burning fuel element through the sleeve and into contact with the evaporative surface of the substrate containing the aerosol forming materials which are evaporated (vaporized) during puffing.

The substrates of the present invention are not intended to burn or scorch appreciably, as this would contribute off-tastes to the delivered smoke-like aerosol. Scorching of the substrate may be eliminated in a number of ways as described in greater detail below. One preferred method involves the placement of the substrate in the sleeve about 1 to 10 mm away from the rear of the fuel element.

The substrates of the present invention provide an efficient low mass evaporating surface for the aerosol forming materials contained therein. Further control over the degree of evaporation may be provided by crimping the paper together, i.e., by reducing its evaporative surface area. If desired, non-wicking or barrier materials (e.g., non-porous materials or treated papers) may be incorporated into the substrates to prevent unwanted evaporation.

As described above, the preferred smoking article includes a short (i.e., less than about 30 mm in length prior to smoking) preferably carbonaceous, combustible fuel element. Typically, the fuel element is an extruded mass, about 9 mm in length and about 4.5 mm in diameter which is provided with a plurality of longitudinally extending passageways, i.e., defined longitudinal hole(s) passing through the inner portion of the fuel element, and/or slots located on the periphery of the fuel element. The passageways provide a surface.area which assists in the lighting of the fuel element, and assists in maintaining burning of the fuel element during smolder. The passageways also aid in controlling the heat transfer from the fuel element the aerosol generating means. The density of a typical fuel element ranges from about 0.856 to about 1.25 g/cc. Fuel elements of this type are described in U.S. application Ser. Nos. 06/840,113 and 06/939,592, the disclosures of which are incorporated herein by reference.

Typically, the fuel element may be circumscribed by an insulating material in the form of a jacket. Jackets of this type are disclosed in greater detail in copending U.S. Patent applications, Ser. Nos. 07/198,725, 07/354,605, and 07/576,751, the disclosures of which are incorporated herein by reference.

The preferred cigarette smoking articles of the present invention also include a roll or charge of tobacco, normally in cut filler form, wrapped in a wrapping material such as paper, thereby forming a tobacco rod. The tobacco roll preferably encircles at least a portion of the aerosol generating means. The tobacco can be in a processed form, such as volume expanded cut filler or aqueous extracted/volume expanded cut filler. The tobacco rod can also include an insulating material such as glass fibers as a component thereof.

The substrate of the present invention is physically separate from, and longitudinally disposed behind, the fuel element. Preferably the substrate is enclosed in a sleeve which, if desired, may be heat conductive or otherwise heat-resistant. Similarly, if desired, the sleeve may be formed from a nonconductive material. The sleeve is located in a passageway which extends longitudinally through the tobacco rod. Exemplary conductive capsules are described in copending application Ser. No. 07/121,463, the disclosure of which is incorporated herein by reference.

The substrate contains one or more aerosol forming materials. Such aerosol forming materials can include tobacco in any form, such as tobacco dust, spray dried tobacco extracts or tobacco essences; and tobacco flavoring agents such as sugars, licorice and cocoa. Other aerosol forming materials which may be used herein include polyhydric alcohols, such as glycerin, propylene glycol and triethylene glycol, which vaporize to produce a visible, "smoke-like" aerosol.

Preferred smoking articles also include a mouthend piece for delivering aerosol to the smoker, which in the case of cigarettes, typically have a tubular shape. However, the mouthend piece may be provided separately, e.g., in the form of a cigarette holder, or as a pipe. The mouthend piece of the preferred smoking articles typically include a filter plug segment. Preferred filter segments exhibit low filtration efficiencies so as to minimize interference with the passage of aerosol from the aerosol generating means to the mouth of the smoker during draw (i.e., upon use). Also preferred are mouthend pieces which include a segment of flavor-containing material, such as a loosely gathered or pleated tobacco paper or menthol-containing pleated carbon filled sheet between the aerosol generating means and the filter segment. Examples of mouthend pieces including these materials are described in U.S. Pat. No. 4,903,714 (Barnes et al.) and copending U.S. Patent application Ser. No. 07/408,433, the disclosures of which are incorporated herein by reference.

As used herein the terms "controlled evaporative surface area" or "evaporative surface" refer to that portion of the surface area of a substrate that is exposed to and contacted by the hot gases emanating from the fuel element, and the point at which evaporation of aerosol forming substances (and optional ingredients) takes place. While not wishing to be bound by theory, it is believed that the hot gases from the fuel element, upon contact with the evaporative surface of the substrate, cool significantly (due to vaporization of the aerosol forming material) so that further contact with other (i.e., non-evaporative) substrate surfaces does not result in substantial vaporization of additional aerosol forming materials.

In some of the preferred embodiments of the present invention, the controlled evaporative surface is deformed to either increase or decrease to area of the evaporative surface that is in contact with the hot gases from the fuel element. Such deformations include crimping, forming a neck (large or small, inward or outward), increasing the density (e.g., by tightly rolling the material), and/or the use of barrier members to prevent contact of the hot gases with certain portions of the substrate. In other preferred embodiments, changing the size (e.g., length, diameter, density) of the substrate has the same effect, i.e., it either increases or decreases the area of possible contact with the hot fuel gases. Combinations of these deformation and/or restriction methods may be used as desired by the skilled artisan.

The terms "wick" or "wicking" are used to define the process of aerosol forming material (and other components) replenishment from the non-evaporative segment of the substrate to the evaporative surface thereof after volatilization of those materials by action of the hot gases from the fuel element.

As used herein, the term "aerosol" is meant to include vapors, gases, particles, and the like, both visible and invisible, and especially those components perceived by the smoker to be "smoke-like" formed by the action of heat generated by the fuel element upon materials contained within the aerosol generating means, or elsewhere in the smoking article.

As used herein, the term "carbonaceous" means comprising primarily carbon. The amount of carbon in the carbonaceous material is typically greater than about 60 percent by weight, preferably greater than about 70 weight percent.

As used herein, the term "insulating materials" applies to all materials which act primarily as insulators. Preferably, these materials do not burn during use, but they may include slow burning carbons and the like materials, as well as materials which fuse during use, such as low temperature grades of glass fibers. Preferred insulating materials used herein are fibrous, e.g., glass fibers, carbon fibers, and the like. Collectively, these materials are often referred to merely as "glass". Suitable insulators have a thermal conductivity in g-cal (sec.) ($cm^2$) (° C./cm), of less than about 0.05, preferably less than about 0.02, most preferably less than about 0.005. See *Hackh's Chemical Dictionary,* 672 (4th ed., 1969) and Lange's *Handbook of Chemistry,* 10, 272–274 (11th ed., 1973).

The term "tobacco-containing" is used herein to describe a material containing tobacco, in any amount, and in any of a variety of forms, including reconstituted tobacco, tobacco extracts, spray dried tobacco extracts, milled tobacco laminae, tobacco fines or dust, shredded or commutated tobacco laminae or stems, volume expanded tobacco and other forms of processed tobacco, and the like.

Preferred smoking articles of the present invention are capable of delivering at least 0.6 mg of the aerosol, measured as wet total particulate matter (WTPM), in the first 3 puffs, when smoked under FTC smoking conditions, which consist of 35 ml puffs of two seconds duration, separated by 58 seconds of smolder. More preferably, embodiments of the invention are capable of delivering 1.5 mg or more of aerosol in the first 3 puffs. Most preferably, embodiments of the invention are capable of delivering 2 mg or more of aerosol in the first 3 puffs when smoked under FTC smoking conditions. Moreover, preferred embodiments of the invention deliver an average at least about 0.2 mg of WTPM per puff, for at least about 6 puffs, preferably at least about 10 puffs, under FTC smoking conditions.

DETAILED DESCRIPTION OF THE PREFERRED EMBODIMENTS

Figure 1:
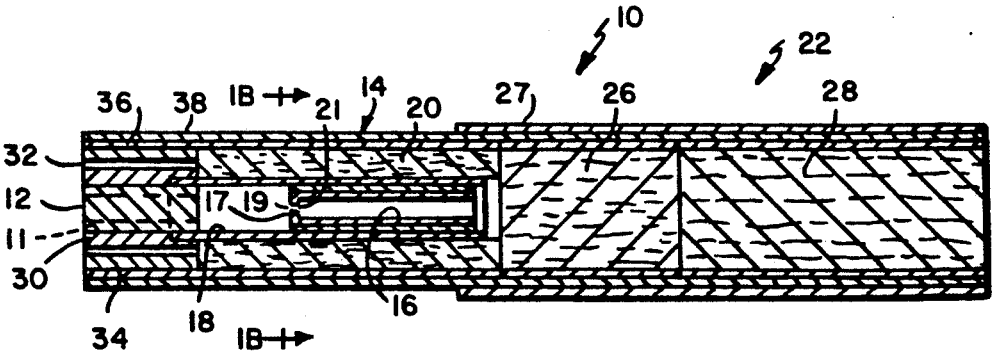
FIG. 1 is a longitudinal sectional view of a cigarette of the present invention.

Referring to FIG. 1, the cigarette smoking article 10 includes a fuel element 12 having a plurality of longitudinally extending passageways 11 (see FIG. 1A); a physically separate aerosol generating means 14, which contains substrate 16, which retains one or more aerosol forming materials and which is disposed behind the fuel element and which is surrounded by sleeve 18. As illustrated, sleeve 18 overlaps the rearward periphery of the fuel element and is at least partially surrounded by tobacco-containing jacket 20.

Figure 1A:
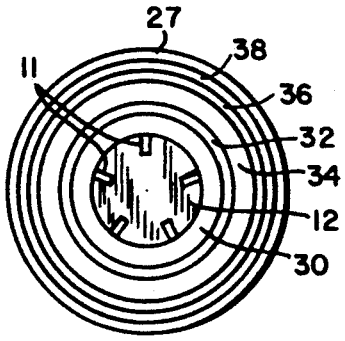
FIG. 1A is a front end view of the cigarette illustrated in FIG. 1.

Referring to FIGS. 1 and 1A, the fuel element 12, when it contains tobacco, is surrounded by a plurality of concentric rings (or annuli) of tobacco-containing material and fibrous insulating material, preferably glass fibers. As illustrated in FIG. 1A, this embodiment comprises a four annuli system including; (1) a first layer, of glass fibers 30, adjacent the outer periphery of the fuel element 12; (2) a first tobacco-containing sheet material 32; (3) a second layer of glass fibers 34, adjacent the first tobacco-containing sheet 32; (3) a second tobacco-containing sheet material 36; and an outer paper wrapper 38.

Substrate 16 is a tube comprising one or more layers of paper-like material with its front end 17 turned in to form an evaporative surface 19 and to define passageway 21. As shown, the front end 17 of the substrate is spaced apart from the rear of the fuel element. Substrate 16 bears at least about 100% by weight of aerosol forming materials. When hot gases from the fuel element volatilize the aerosol forming materials from the evaporative surface 19, a portion of the remaining aerosol forming materials wicks to the evaporative surface.

As illustrated, mouthend piece 22 consists of two sections, namely (1) a segment of loosely gathered web of tobacco paper 26, which adds flavor to the aerosol, and (2) a web of non-woven polypropylene, serving as filter element 28. Optionally, a void space (not shown) can be included in the mouthend piece, either between the sleeve and the tobacco paper, or elsewhere.

A typical cigarette of the present invention has a generally circular cross-section and a circumference of from about 23 mm to about 28 mm, and a length of from about 70 mm to about 100 mm.

Referring in detail to FIG. 1, the fuel element 12 is held in place by sleeve 18 by virtue of the overlap of the sleeve with approximately the rear 2–3 mm of the fuel element periphery. The sleeve has a diameter just large enough to accept the fuel element snugly and hold it, e.g., by friction fit.

As shown in FIG. 1, the aerosol generating means 14 is preferably surrounded by a rod, roll, or some other form of tobacco 20, generally in the form of cut filler. This tobacco segment is heated, but not necessarily burned, by the heat from the fuel element, resulting in the release of tobacco flavor components into the mainstream aerosol during smoking. This tobacco segment also provides the cigarette with resiliency which aids in manufacture using modern high speed cigarette manufacturing equipment.

The combination of the fuel element 12 and the substrate sleeve 18, may be spaced apart from the mouthend piece 22 by a void space (not shown). This void space may range in size from about 5 mm to about 30 mm, preferably from about 10 mm to about 15 mm, with adjustments made to the sizes of the other components of the mouthend piece as required. This void space has two primary functions, (1) it allows the hot gases exiting the aerosol generating means to cool before reaching the smoker and (2) it aids in the formation of a visible smoke by serving as a nucleation chamber for the aerosol. Alternatively, the void space may be omitted, i.e., the space shown may be filled, e.g., with flavor additive materials, low efficiency filter materials, and the like.

The mouthend piece 22 preferably is configured and dimensioned such that it can be butted against the front end assembly comprising the jacketed fuel element and capsule with a simple paper overwrap. Alternatively, the outer layer of the mouthend piece may be manufactured from any available material, e.g., metal foil - lined paper tubes, molded plastic, heavy weight paper, or the like.

Within the tubular mouthend piece 22 a roll 26 of tobacco-containing sheet material, or carbon filled sheet material containing a flavor substance such as menthol, or some other flavor source, preferably circumscribed by a paper wrapper. Also within the mouthend piece, and positioned at the extreme mouth end of the cigarette, is a low efficiency filter element 28 including a filter material such as gathered web of non-woven polypropylene fibers, and a circumscribing plug wrap. If desired, tipping paper 27 can circumscribe the mouthend piece of the cigarette and join the mouthend piece to the front end assembly. Additionally, if desired, a ring of air dilution perforations can be provided near the extreme mouth end region of the cigarette using known laser or mechanical perforation techniques.

While the substrate of FIG. 1 represents one embodiment of the present invention, additional embodiments have been designed for use in cigarettes and other smoking articles. FIGS. 2–7 illustrate alternative substrate embodiments for use in the cigarette of FIG. 1 or other smoking articles.

Figure 2A:
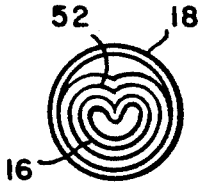
FIG. 2A is a front end view of the paper substrate illustrated in FIG. 2.
Figure 2:
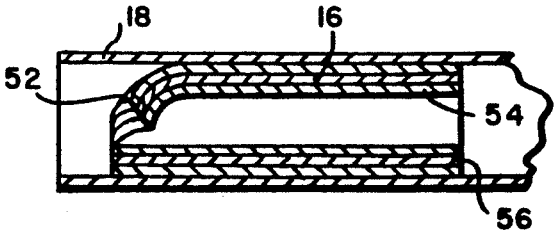
FIG. 2 is a longitudinal sectional view of one embodiment of the paper substrate.

Referring in detail to FIGS. 2 and 2A, substrate 16 is shown in the form of a roll of one or more layers of paper, crimped down at its front end 52. Aerosol forming materials which are loaded on this substrate wick to surface 52 and evaporate into the hot gas stream drawn from the burning fuel element [not shown]. An optional barrier member 54 may be used to further promote wicking of the aerosol forming materials to the front end surface 52. Alternatively or additionally, each paper layer of this substrate can be formed with a barrier layer on one side thereof, thereby precluding wicking of aerosol forming materials through the paper layers to the center of the substrate.

Figure 3A:
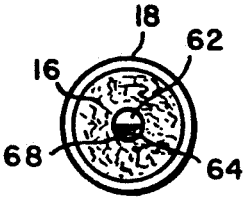
FIG. 3A is a front end view of the paper substrate illustrated in FIG. 3.
Figure 3:
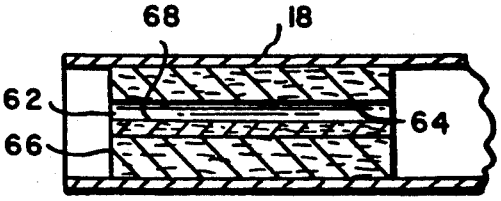
FIG. 3 is a longitudinal sectional view of one embodiment of the paper substrate.

Referring in detail to FIGS. 3 and 3A, substrate 16 is illustrated which comprises a gathered web or strands of cellulosic material 60 with a central passageway 62, formed by a tubular barrier or wicking member 64. If desired, a partition 68 of wicking material can be provided within tubular member 64. In use, the aerosol forming materials on this substrate wick toward front end 66 of the substrate closest to the fuel element and to the wicking member 64 and partition 68, if present. If desired, two substrates of this type may be employed in cigarettes and other smoking articles. The first substrate, which would be shorter than that shown in FIG. 3, and without the central passageway, would serve as a booster, providing early aerosol and flavor. Before the booster substrate has been depleted, the second substrate would be providing aerosol to the smoker, without any detectable pause or interruption in delivery.

Figure 4A:
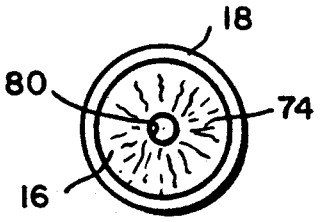
FIG. 4A is a front end view of the paper substrate illustrated in FIG. 4.
Figure 4:
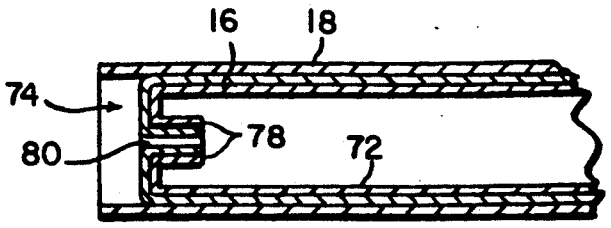
FIG. 4 is a longitudinal sectional view of one embodiment of the paper substrate.

Referring in detail to FIGS. 4 and 4A, substrate 16 is shown in the form of a tube comprising one or more layers of wicking paper. The tube is optionally provided with a barrier material or coating 72 on the inside surface. The end of the tube 74 adjacent to the rear end of the fuel element, is turned-in so that the front face surface 76 and the inside surface 78, together form the evaporative surface. Hot gas from the fuel element contacts surfaces 76 and 78 evaporating volatile flavorants and aerosol forming materials as they pass through orifice 80. As these materials are volatilized, the wicking action replenishes the evaporative surfaces.

Figure 5A:
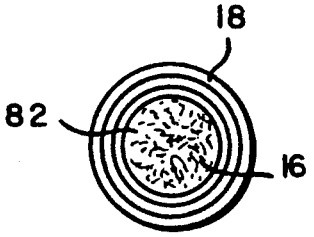
FIG. 5A is a front end view of the paper substrate illustrated in FIG. 5.
Figure 5:
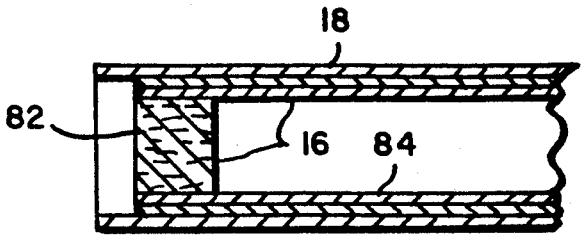
FIG. 5 is a longitudinal sectional view of one embodiment of the paper substrate.

Referring in detail to FIGS. 5 and 5A, a two part substrate 16 is shown. The first part 82 (nearest the fuel element) comprises an air permeable filter plug, i.e., a gathered web or strands of cellulosic material. The second part of this substrate is a tube of wicking paper 84 which is in contact with the periphery of the plug 82. The air permeable plug provides a very low mass evaporating surface while the wicking paper 84 serves as a reservoir to supply aerosol forming materials and flavorants to the plug.

Figure 6A:
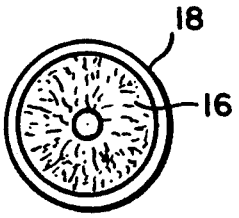
FIG. 6A is a front end view of the paper substrate illustrated in FIG. 6.
Figure 6:
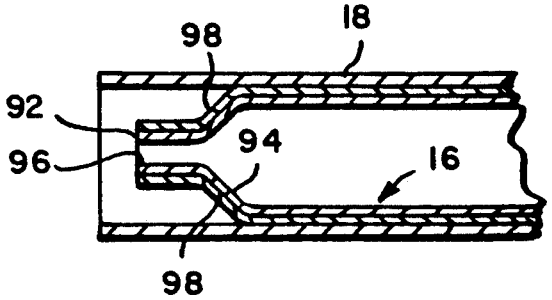
FIG. 6 is a longitudinal sectional view of one embodiment of the paper substrate.

Referring in detail to FIGS. 6 and 6A, substrate 16 is shown in the form of a sleeve of wicking paper crimped or necked down at its front end 92, forming a small evaporative surface on the interior of the neck 94. The orifice 96 directs the hot gases from the fuel element over the small evaporative surface. The size of the neck 94 can be varied, e.g., in length and/or diameter to provide any desired evaporative surface area. Optionally, a barrier member [not shown]may be placed on the outside surface 98 of the neck, preventing vaporization from that surface.

Figure 7A:
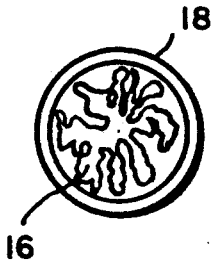
FIG. 7A is a front end view of the paper substrate illustrated in FIG. 7.
Figure 7:
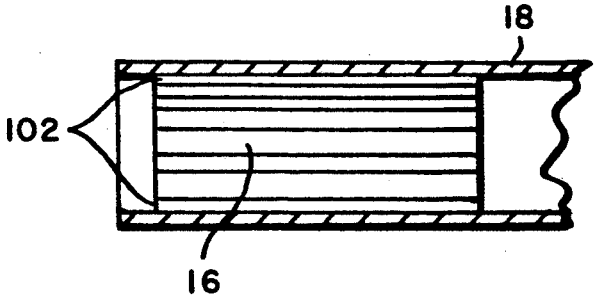
FIG. 7 is a longitudinal sectional view of one embodiment of the paper substrate.

Referring in detail to FIGS. 7 and 7A, substrate 16 is shown in the form of a gathered paper web 100. Surrounding the periphery of the web is a circumscribing paper wrapper 102. The gathered paper web can be either loosely packed or tightly packed, depending upon the evaporative surface area required. Packing density may be modified by the amount of paper used and/or the thickness of the paper used to form the gathered web. Packing density also affects the pressure drop. If desired an optional barrier layer or coating [not shown]may be included on one surface of the paper used to form the gathered web. This would reduce the evaporative surface area by about 50%.

As described above, the substrates of the present invention are not intended to burn or scorch appreciably during smoking. Several methods have been found capable of reducing or eliminating the burning or scorching potential of the substrates. One method involves the positioning of the substrate in the sleeve, from about 2 to 10 mm, preferably, from about 2 to 5 mm, from the rear of the fuel element. Another method for preventing burning and/or scorching of the substrate involves adding a high concentration of aerosol forming material on the substrate in a liquid form. As the liquid evaporates, it cools the substrate temperature, preventing scorching. It has also been found that if sufficient water, e.g., from about 5 to about 15 % by weight, is added to glycerin, the substrate does not burn or scorch.

A preferred method of preventing scorching and/or burning of the substrate combines two of the above recited methods. First, the substrate is located at least about 2 mm from the rear of the fuel element,and second, the substrate is saturated, i.e., it carries at least 100%, preferably at least 200% by weight of an aerosol forming material. This way, since the aerosol former is exposed to the hot fuel gases in liquid form, the hot gases are initially saturated with vapor before the temperature of the paper can increase substantially, thereby preventing scorching or burning.

Other methods useful for preventing the scorching and/or burning of the substrate involve structural changes in the cigarette design. For example, forming air slots between the fuel element and the sleeve, e.g., by cutting away part of the rear periphery of the fuel element, can effectively cool the otherwise hot gases passing through the substrate. Similarly, the hot gases from the fuel can be cooled by modifying the configuration of the substrate, such that the gases pass partially around the substrate, effectively cooling them. Finally, if desired, air dilution may be employed between the fuel element and the substrate, effectively cooling the gases before they contact the substrate.

As described above, the aerosol generating means includes the cellulosic substrates of the present invention. As defined herein, a "cellulosic material" is a material which is at least 50% by weight cellulose. Other absorbent or adsorbent materials, e.g., carbon, alumina, and the like, may be present in the cellulosic material (e.g., dispersed therein) if desired. The object of the substrate is to retain the aerosol forming material when not in use and release the aerosol forming material during smoking.

Some of the many cellulosic materials useful as substrates herein include; paper, wood pulp, rayon, plant or vegetable fibers, e.g., cotton, kapok, hemp, jute, and the like. Both woven and non-woven cellulosic materials are suitable for use as substrates. Papers, particularly nonwoven papers, are an especially preferred substrate material.

It is believed that all cellulosic materials have a wicking property, i.e., they can transport a liquid material from one source to another, e.g., by capillary action. This wicking property of cellulosic materials is a key to the successful use of these materials as substrates in cigarettes and other smoking articles.

As described above, in some embodiments of the present invention, two separate substrates are used. The first substrate, or booster, is used to provide early aerosol and flavor, i.e., in the first three or four puffs. The second substrate, or sustaining substrate is used to provide continued aerosol and flavor after the booster has run dry, i.e., from about puffs 3–12.

If desired, a longitudinal passageway may be placed in the center of the booster substrate to prevent (or decrease) excessive aerosol delivery during the second, third and fourth puffs. Advantageously, the booster substrate also acts as a filter. The fibrous paper, saturated with glycerin picks up particles such as carbon dust, and the like, and prevents them from passing through the article with the aerosol.

In other preferred embodiments of the invention, no boster substrate is used. In these substrate configurations, a single substrate is adequate for delivery (early and sustained) of aerosol and flavorants.

As described above the substrates of the present invention have a controlled evaporative surface. Typically, this surface is the forward portion of the substrate, i.e., that surface closest to the rear of the fuel element. In those embodiments where a passageway is provided through the substrate, the passageway may also serve as the evaporative surface, unless wholly or partially modified to include a barrier member.

Moreover, as illustrated, the evaporative surface on several of the aforementioned substrate configurations has been restricted, i.e., has been reduced by either a structural modification, the addition of a barrier, or the like. These restrictions are employed in order to form a smaller evaporative surface to promote the generation of early aerosol. As illustrated, these modifications include crimping of the front end of the substrate (FIG. 2), the use of barrier members (FIGS. 3, 4, 5), forming a neck in the substrate tube (FIG. 4—inward, FIG. 6—outward), and the like. The evaporative surface of the substrate of FIG. 7 may be restricted by (a) reducing the length of the substrate, (b) increasing the density of the substrate, or both.

Controlling the amount of vapor generated over a wide range of temperatures is an important consideration when using the substrates of the present invention. It has been found that due to the wicking process which takes place within the cellulosic substrates, glycerin, water and the flavorants migrate to the evaporative surface in the same proportion as originally placed on the substrate, thereby ensuring consistent flavor delivery during each puff (after the lighting puff).

Cigarettes may thus be prepared having any desired specific flavor level, such as light, medium, and heavy, while still delivering the same amount of aerosol per puff. In setting the flavor level, an under-concentration of flavorants in the mixture will result in an under-delivery, and thus a weak flavor, while an over-concentration of flavorants will result in an over-delivery, and hence, a strong flavor.

One preferred cellulosic substrate of the present invention has the form of a non-woven sheet-like material, such as paper, carbon paper, tobacco paper, or the like. Such a substrate is typically provided as a cylindrical segment including a shredded, gathered, pleated, or crimped web of paper-like material. If desired, portions of the paper used to form the substrate may be coated or treated (e.g., chemically) to form a barrier layer or barrier member. Examples of suitable barrier coating materials include ethyl cellulose, which is applied as a dilute solution in ethanol, and a material commercially available as Hercon 70 from Hercules, Inc. The barrier prevents wicking of the aerosol forming materials through the paper. Depending upon its positioning, a barrier material may be used to guide the direction of the wicking process. The barrier material may be made up from other materials, including aluminum foil, plastic, and the like.

Cylindrical segments such as those described above may be formed into rods using equipment and techniques described in U.S. Pat. No. 4,807,809, Pryor et al. Exemplary papers which have been gathered into substrates include MS2408/S538 from Filtrona, Ltd. as well as p-1976-29-5, p-1976-29-7, P-1976-29-1, P-1976-29-8 and P-1976-29-11 from Kimberly-Clark Corp. Combinations of two or more papers or paper-like materials can also be used herein. These paper materials can include filler materials (e.g., carbon, alumina and the like) having certain pore structures physically mixed therewith and/or incorporated therein in order to control migration of the aerosol forming material from the substrate.

Exemplary tobacco papers gathered to form substrates are available as P144-GNA from Kimberly-Clark Corp., and also include carbon filled tobacco sheet materials, such as those described in European Patent Publication No. 342,538, which is incorporated herein by reference.

The aerosol generating means also includes at least one aerosol forming material. The aerosol forming material generally has a liquid form. Examples of preferred aerosol forming materials include the polyhydric alcohols (e.g., glycerin, propylene glycol and triethylene glycol), the aliphatic esters of mono-, di-, or poly-carboxylic acids (e.g., methyl stearate, dimethyl dodecandioate and dimethyl tetradecanedioate), and the like.

The amount of aerosol forming material which is employed per smoking article can vary and depends upon factors such as the components of the aerosol forming material and the composition of the particular substrate which carries the aerosol forming material. Generally the amount of aerosol forming material employed per smoking article ranges from about 20 mg to about 200 mg, preferably from about 35 mg to about 150 mg.

The preferred aerosol forming material, glycerin, has an affinity for moisture, particularly atmospheric moisture. On standing glycerin will absorb moisture, based upon the relative humidity present. For example, at a relative humidity of 40%, glycerin will absorb about 15% weight percent of water. This affinity for water can affect the delivery of the aerosol from cigarettes and other smoking articles.

Using the wicking substrates of the present invention and the water affinity of glycerin, smoking articles can be prepared which have a uniform aerosol delivery on each puff. This is accomplished by adding water to the glycerin as another aerosol forming material, based upon a 40% relative humidity factor, i.e., at about 15% by weight. By adding water during formation of the product, the glycerin looses most, if not all, of its affinity for additional water, and thus a consistent delivery can be achieved.

Examples of other aerosol forming materials include volatile flavoring agents and tobacco flavor modifiers. Volatile flavoring agents include vanillin, cocoa, licorice, organic acids, high fructose corn syrup, and the like. Various other flavoring agents for smoking articles are set forth in Leffingwell et al., *Tobacco Flavorino For Smoking Products* (1972) and in U.S. Patent application Ser. No. 378,551, filed Jul. 11, 1989. Tobacco flavor modifiers include levulinic acid, metal (e.g., sodium, potassium calcium and magnesium) salts of levulinic acid, and the like.

The preferred heat source or fuel element for use in the smoking articles of the present invention is manufactured from a combustible material in such a way that the density of the fuel element is greater than about 0.5 g/cc, frequently about 0.7 g/cc or more, often about 1 g/cc or more, sometimes about 1.5 g/cc or more, but typically less than about 2 g/cc. Additionally, the fuel element generally has a length, prior to burning, of less than about 20 mm, often less than about 15 mm, and frequently less than about 10 mm.

The composition of the combustible material of the fuel element can vary. Preferred fuel elements contain carbon, and highly preferred fuel elements are composed primarily of carbonaceous materials. Preferred carbonaceous materials have a carbon content above about 60 weight percent, more preferably above about 75 weight percent, and most preferably above about 85 weight percent. Flavors, tobacco extracts, fillers (e.g. clays or calcium carbonate), burn additives (e.g., sodium chloride to improve smoldering and act as a glow retardant), combustion modifying agents (e.g., potassium carbonate to control flammability), binders, and the like, can be incorporated into the fuel element.

Exemplary compositions of preferred carbonaceous fuel elements are set forth in U.S. Pat. Nos. 4,714,082 to Banerjee et al., 4,756,318 to Clearman et al., and U.S. patent application Ser. No. 378,551, filed Jul. 11, 1989; U.S. Patent application Ser. No. 574,327, filed Aug. 28, 1990, as well as in European Patent Publication No. 236,992 which are incorporated herein by reference.

Other exemplary carbonaceous materials are coconut hull carbons, such as the PXC carbons available as PCB and the experimental carbons available as Lot B-11030-CAC-5, Lot B-11250-CAC-115 and Lot 089-A12-CAC-45 from Calgon Carbon Corporation, Pittsburgh, PA.

Other fuel elements can be provided from comminuted tobacco material, reconstituted tobacco material, heat treated or pyrolyzed tobacco materials, cellulosic materials, modified cellulosic materials, and the like. Exemplary materials are set forth in U.S. Pat. Nos. 4,347,855 to Lanzilotti et al.; 3,931,824 to Miano et al.; 3,885,574 to Borthwick et al. and 4,008,723 to Borthwick et al.; as well as in Sittig, *Tobacco Substitutes*, Noyes Data Corp. (1976).

Fuel elements for smoking articles of the present invention advantageously are molded, machined, pressure formed or extruded into the desired shape. Molded fuel elements can have passageways, grooves or hollow regions therein. Preferred extruded carbonaceous fuel elements can be prepared by admixing up to 95 parts carbonaceous material, up to 20 parts binding agent and up to 20 parts tobacco (e.g., tobacco dust and/or a tobacco extract) with sufficient water to provide a paste having a stiff dough-like consistency. The paste then can be extruded using a ram or piston type extruder into an extrudate of the desired shape having the desired number of passageways or void spaces.

Surrounding the outer periphery of the fuel element is an insulating wrapper. This wrapper, which may comprise glass fibers (e.g., E-glass, C-glass or the like), glass and tobacco materials (see, U.S. Pat. No. 4,756,318 and U.S. Patent application Ser. No. 576,751, filed Aug. 29, 1990), or other substitute insulating materials (see, U.S. Patent application Ser. No. 354,605, filed May 22, 1989) retains heat from the burning fuel element and directs it toward the aerosol generating means. Typical glass fibers for use in the insulating wrapper are described in *New Cigarette Prototypes that Heat Instead of Burn Tobacco*, pages 48–52, which is incorporated herein by reference.

In the tobacco burning cigarette embodiments of the present invention, a carbonaceous sheet material can circumscribe the fuel element. The carbonaceous sheet material is used to assist in the lighting of the fuel element. The carbon sheet material is further circumscribed by a fibrous insulating material such as glass fibers. The fibrous insulating material is typically from about 0.6 to about 1.5 mm thick, preferably about 1.2 mm thick. Circumscribing the outer periphery of the insulating material is a tobacco containing sheet. The thickness of the tobacco containing sheet material is typically from about 0.09 to about 0.17 mm, preferably about 0.13 mm. For other smoking articles, the skilled artisan would vary the thicknesses of each component as necessary.

When the fuel element does not contain tobacco (i.e., in the non-tobacco burning embodiments), the insulating material is preferably composed of a jacket of glass fibers. In the tobacco warming (i.e., non-burning) cigarette embodiments of the present invention, the jacket of fibrous insulating material is typically from about 0.6 to about 1.5 mm thick, preferably about 1.2 mm thick.

The longitudinal outer periphery of the conductive sleeve for the substrate is circumscribed by a tobacco containing rod or roll, comprising e.g., cut filler. This tobacco jacket is warmed by the heat generated by burning fuel element which is transferred to the sleeve and the flavors released by this heating are combined with the aerosol and flavor materials during draw. Typical tobacco jacket are described in U.S. Pat. No. 4,756,318 (Clearman et al.) and in copending U.S. Patent application Ser. Nos. 07/216,082, 07/467,726 and 07/576,751, the disclosures of which are incorporated herein by reference.

In most embodiments of the present invention, the fuel element/sleeve assembly which contains the substrate and the aerosol forming material is permanently attached to a mouthend piece; although a disposable fuel element and sleeve assembly can be employed with a separate reusable mouthend piece, such as a reusable cigarette holder. The mouthend piece provides a passageway which channels the aerosol into the mouth of the smoker; and can also provide further flavor to the aerosol. Typically, the length of the mouthend piece ranges from 40 mm to about 85 mm.

Typically, the length of the mouthend piece is such that (i) the burning portion of the fuel element and the hot heat conducting member are kept away from the mouth and fingers of the smoker; and (ii) vaporized aerosol forming materials have sufficient time to cool before reaching the mouth of the smoker. Often, it is highly desirable to provide a void space within the mouthend piece immediately behind the aerosol generating means. For example, a void space extending at least about 10 mm along the length of the smoking article may be provided immediately behind the aerosol generating means and forward of any materials situated in the mouthend piece.

Suitable mouthend pieces normally are inert with respect to the aerosol forming material, offer minimum aerosol loss as a result of condensation of filtration, and are capable of withstanding the temperatures experienced during use of the smoking article. Exemplary mouthend pieces include plasticized cellulose acetate tubes, such as is available as SCS-1 from American Filtrona Corp.; polyimide tubes available as Kapton from E. I. duPont de Nemours; papers, paperboard or heavy paper tubes; and aluminum foil-lined paper tubes.

The extreme mouthend of the smoking article preferably includes a filter element, or "filter tip," particularly for aesthetic reasons. Preferred filter elements are low efficiency filter elements which do not interfere appreciably with aerosol yields. Suitable filter materials include low efficiency cellulose acetate or polypropylene tow, baffled or hollow molded polypropylene materials, or gathered webs or nonwoven polypropylene materials. Suitable filter elements can be provided by gathering a non-woven polypropylene web available as PP-100-F from Kimberly-Clark Corp. using the filter rod forming apparatus described in Example 1 of U.S. Pat. No. 4,807,809 to Pryor et al.

The entire length of the smoking article, or any portion thereof, can be overwrapped with cigarette paper. Preferred papers which circumscribe the front end of the smoking article having the insulated fuel element and sleeve assembly, should not openly flame during use of the smoking article, should have controllable smolder properties, and should produce a gray ash. Exemplary, cigarette papers are described in U.S. Pat. No. 4,779,631 to Durocher et al., U.S. Patent application Ser. No. 574,327, filed Aug. 28, 1990, and European Patent Publication No. 304,766. Suitable paper wrappers are available as P1981-152, P1981-124 and P1224-63 from Kimberly-Clark Corp. Tipping paper can circumscribe the extreme mouthend of the smoking article Suitable tipping papers are non-porous tipping papers treated with "non-lipsticking" materials, and such papers will be apparent to the skilled artisan.

The smoking articles of the present invention incorporate one or more forms of tobacco. The form of the tobacco can vary, as can the location or locations of the tobacco in the particular smoking article. The tobacco can be incorporated in the fuel element, the aerosol generating means, and/or positioned within the mouthend piece in a manner so that various flavorful tobacco components are transferred to drawn aerosol passing through the mouthend piece. The type of tobacco can vary, and includes flue-cured, Burley, Maryland and Oriental tobaccos, the rare and specialty tobaccos, as well as blends thereof.

One form of tobacco widely used in the smoking articles of the present invention is tobacco cut filler, e.g., strands or shreds of tobacco filler having widths of about 1/15 inch to about 1/40 inch, and lengths of about ¼ inch to about 3 inches). Tobacco cut filler can be provided in the form of tobacco laminae, volume expanded or puffed tobacco laminae, processed tobacco stems including cut-rolled or cut-puffed stems, or reconstituted tobacco material. Reconstituted tobacco material can be provided using cast sheet techniques; paper making techniques; or extrusion techniques, such as are described in U.S. Pat. No. 4,821,749 to Toft et al. Cut filler normally is incorporated into the cigarette as a cylindrical roll of charge of tobacco material which is wrapped in a circumscribing paper wrapper. Tobacco cut filler can be provided as a roll in a paper wrapper using cigarette rod making techniques and apparatus which are well known by the skilled artisan. Tobacco cut filler also can be incorporated in the aerosol generating means, if desired.

Another form of tobacco especially useful herein is tobacco paper. For example, a web of tobacco paper available as P144-GNA from Kimberly-Clark Corp. can be gathered into a cylindrical segment in a manner set forth in Example 2 of U.S. Pat. No. 4,807,809 to Pryor et al. Cylindrical segments of gathered tobacco paper can be incorporated (i) into the cartridge of the cigarette to act as a substrate for the aerosol forming material, and/or (ii) within the mouthend piece of the cigarette. If desired, tobacco paper can form an inner liner of the mouthend piece of the smoking article.

A segment of gathered tobacco paper can be incorporated into the mouthend piece. Such a segment can be positioned directly behind the heat conducting member which contains the aerosol forming material. Tobacco paper containing carbon can be incorporated into the mouthend piece, particularly in order to introduce menthol flavor to the aerosol. Suitable tobacco-carbon paper segments are described in European Patent Publication No. 342,538.

Another form of tobacco useful herein is finely divided tobacco material. Such a form of tobacco includes tobacco dust and finely divided tobacco laminae. Typically, finely divided tobacco material is carried by the substrate which is positioned within the aerosol generating means. However, finely divided tobacco material also can be incorporated into the fuel element.

Another form of tobacco which is typically used for flavor herein is a tobacco extract. Tobacco extracts typically are provided by extracting a tobacco material using a solvent such as water, carbon dioxide, sulfur hexafluoride, a hydrocarbon such as hexane or ethanol, a halocarbon such as a commercially available Freon, as well as other organic and inorganic solvents. Tobacco extracts can include spray dried tobacco extracts, freeze dried tobacco extracts, tobacco aroma oils and tobacco essences.

Methods for providing suitable tobacco extracts are set forth in U.S. Pat. No. 4,506,682 to Muller; European Patent Publication Nos. 326,370 and 338,831; and U.S. Patent application Ser. Nos. 346,042 filed May 2, 1989 and 452,175 filed Dec. 18, 1989.

Also useful are flavorful tobacco compositions such as those described in U.S. Patent application Ser. No. 435,951, filed Nov. 13, 1989. Typically, at least one tobacco extract is carried by the substrate of the aerosol generating means; although the tobacco cut filler, tobacco paper and filter material are positioned elsewhere within the cigarette. Furthermore, tobacco extract can be incorporated into the fuel element.

Additionally or alternatively, if desired, a segment including a gathered web of non-woven polypropylene in intimate contact with a water soluble tobacco extract can be incorporated into the mouthend piece. Such a segment is described in U.S. Patent application Ser. No. 414,835, filed Sep. 29, 1989.

Smoking articles of the present invention are capable of providing at least about 6 to about 10 puffs, when smoked under FTC smoking conditions. FTC smoking conditions consist of a 35 ml puff volume of 2 seconds duration, separated by 58 seconds of smolder.

Preferred smoking articles of the present invention are capable of yielding at least about 0.6 mg of aerosol, measured as wet total particulate matter (WTPM), in the first 3 puffs, when smoked under FTC smoking conditions. Moreover, preferred smoking articles yield an average of at least about 0.2 mg of WTPM per puff, for at least about 6 puffs, preferably at least about 10 puffs, when smoked under FTC smoking conditions. Highly preferred smoking articles yield at least about 5 mg of WTPM over at least 10 puffs, when smoked under FTC smoking conditions.

The following examples are provided in order to further illustrate various embodiments of the invention, but should not be construed as limiting the scope thereof. Unless otherwise noted, all parts and percentages are by weight.

EXAMPLE 1

Tobacco Burning Cigarette

Fuel Element Preparation

A generally cylindrical fuel element 9 mm long and 4.5 mm in diameter, and having an apparent (bulk) density of about 1.02 g/cc is prepared from about 72 parts hardwood pulp carbon having an average particle size of 12 microns in diameter, about 20 parts of blended tobacco dust including Burley, flue cured and oriental, the dust being approximately 200 Tyler mesh, and 8 parts Hercules 7HF SCMC binder.

The hardwood pulp carbon is prepared by carbonizing a non-talc containing grade of Grande Prairie Canadian kraft hardwood paper under nitrogen blanket, increasing the temperature in a step-wise manner sufficient to minimize oxidation of the paper, to a final carbonizing temperature of at least 750° C. The resulting carbon material is cooled under nitrogen to less than 35° C., and then ground to fine power having an average particle size of about 12 microns in diameter.

The finely powdered hardwood carbon is admixed with the tobacco dust, the sodium carboxymethyl cellulose binder, and sufficient water to provide a mixture having a stiff, dough-like paste form.

Figure 1B:
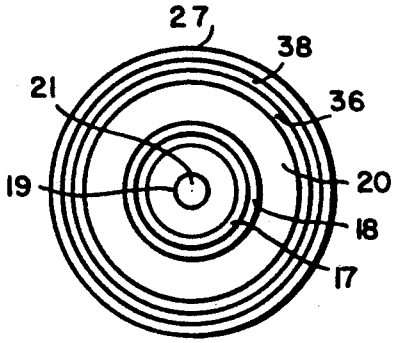
FIG. 1B is a sectional view of the cigarette illustrated in FIG. 1, taken along line 1B—1B.

Fuel elements are extruded using a ram extruder from the paste so as to have 5 equally spaced peripheral passageways in the form of slots or grooves, each having a depth of about 0.032 inch and a width of about 0.016 inch. The configuration of the passageways which extend longitudinally through the fuel element is shown in FIG. 1B. The resulting extrudate is dried in air to provide a resilient extrudate, and the extrudate is cut into 9 mm lengths, thereby providing fuel elements.

Substrate Preparation

A 14 mm×40 mm sheet of wicking paper (Kimberly-Clark P1976-29-8) is rolled around a 2 mm diameter metal die, into a 14 mm long tube having a plurality of layers with an outer diameter (o.d.) of about 4.5 mm and an inner diameter (i.d.) of about 2 mm. The tube is removed from the die and one end of the tube is crimped (see FIGS. 2 and 2A) so that the 2 mm diameter opening is closed by about 50%, thereby reducing the evaporative surface.

Sleeve Assembly

A metal capsule is manufactured from aluminum using a metal drawing process. The capsule has a length of about 30 mm, an outer diameter of about 4.6 mm, and an inner diameter of about 4.4 mm. One end of the capsule (the fuel element end) is open; and the other end is closed, except for two slot like openings. The closed end of the capsule is modified to have a single opening of about 4 mm in diameter, thereby converting the capsule into a sleeve.

The 14 mm long substrate (about 48 mg) is placed in the sleeve with the crimped end at the front, and positioned toward the rear thereof, at least about 4 to 5 mm from the open end (i.e., the front end). About 125 mg of glycerin (or a mixture of glycerin and flavorants) is added to the substrate. The substrate quickly absorbs the liquid. A fuel element is inserted into the front end of the sleeve to a depth of about 2 mm. As such, the fuel element extends about 7 mm beyond the open end of the sleeve, and the substrate is separated from the rear of the fuel element by about 2 to 3 mm.

Insulating Jacket

A 15 mm long, 4.5 mm diameter plastic tube is overwrapped with an insulating jacket material that is also 15 mm in length. In these cigarette embodiments, the insulating jacket is composed of 2 layers of Owens-Corning C-glass mat, each about 1 mm thick prior to being compressed by the jacket forming machine, and after formation, each being about 0.6 mm thick. Sandwiched between the two layers of C-glass is one sheet of reconstituted tobacco paper, about 0.13 mm thick, and a second sheet of 0.13 mm thick reconstituted tobacco paper overwraps the outer layer of glass. The reconstituted tobacco paper sheet, designated P2674-157 from Kimberly-Clark Corp., is a paper-like sheet containing a blended tobacco extract. The width of the reconstituted tobacco sheets prior to forming are 19 mm for the inner sheet and 26.5 mm for the outer sheet. The final diameter of the jacketed plastic tube is about 7.5 mm.

Tobacco Roll

A tobacco roll consisting of volume expanded blend of Burley, flue cured and oriental tobacco cut filler is wrapped in a paper designated as P1487-125 from Kimberly-Clark Corp., thereby forming a tobacco roll having a diameter of about 7.5 mm and a length of about 22 mm. See U.S. Patent application Ser. No. 07/505,339, filed Apr. 5, 1990, for a preferred volume expanded tobacco process.

Front End Assembly

The insulating jacket section and the tobacco rod are joined together by a paper overwrap designated as P2674-190 from Kimberly-Clark Corp., which circumscribes the length of the tobacco/glass jacket section as well as the length of the tobacco roll. The mouth end of the tobacco roll is drilled to create a longitudinal passageway therethrough of about 4.6 mm in diameter. The tip of the drill is shaped to enter and engage the plastic tube in the insulating jacket. The cartridge assembly is inserted from the front end of the combined insulating jacket and tobacco roll, simultaneously as the drill and the engaged plastic tube are withdrawn from the mouth end of the roll. The cartridge assembly is inserted until the lighting end of the fuel element is flush with the front end of the insulating jacket. The overall length of the resulting front end assembly is about 37 mm.

Mouthend Piece

The mouthend piece includes a 20 mm long cylindrical segment of a loosely gathered tobacco paper and a 20 mm long cylindrical segment of a gathered web of non-woven, melt-blown polypropylene, each of which includes an outer paper wrap. Each of the segments are provided by subdividing rods prepared using the apparatus described U.S. Pat. No. 4,807,809 (Pryor et al.)

The first segment is about 7.5 mm in diameter, and is provided from a loosely gathered web of tobacco paper available as P1440-GNA from Kimberly-Clark Corp. which is circumscribed by a paper plug wrap available as P1487-184-2 from Kimberly-Clark Corp.

The second segment is about 7.5 mm in diameter, and is provided from a gathered web of non-woven polypropylene available as PP-100 from Kimberly-Clark Corp. which is circumscribed by a paper plug wrap available as P1487-184-2 from Kimberly-Clark Corp.

The two segments are axially aligned in an abutting end-to-end relationship, and are combined by circumscribing the length of each of the segments with a paper overwrap available as L-1377-196F from Simpson Paper Company, Vicksburg, Mich. The length of the mouthend piece is about 40 mm.

Final Assembly of Cigarette

The front end assembly is axially aligned in an abutting end-to-end relationship with the mouthend piece, such that the container end of the front end assembly is adjacent to the gathered tobacco paper segment of the mouthend piece. The front end assembly is joined to the mouthend piece by circumscribing the length of the mouthend piece and a 5 mm length of the from end assembly adjacent the mouthend piece with tipping paper.

Use

In use, the smoker lights the fuel element with a cigarette lighter and the fuel element burns. The smoker inserts the mouth end of the cigarette into his/her lips, and draws on the cigarette. A visible aerosol having tobacco flavor is drawn into the mouth of the smoker.

EXAMPLE 2

Tobacco Heating (Nonburning) Cigarette

Fuel Source Preparation

A generally cylindrical fuel element 9 mm long and 4.5 mm in diameter, and having an apparent (bulk) density of about 0.93 g/cc is prepared from about 92 parts hardwood pulp carbon having an average particle size of 12 microns in diameter, and 8 parts high viscosity ammonium alginate binder, available as Amoloid HV from Kelco Division of Merck & Co. Alternatively, the binder used in Example 1 may be used herein.

The hardwood pulp carbon is prepared by carbonizing a non-talc containing grade of Grand Prairie Canadian Kraft hardwood paper under nitrogen blanket, increasing the temperature in a step-wise manner sufficient to minimize oxidation of the paper, to a final carbonizing temperature of at least 750° C. The resulting carbon material is cooled under nitrogen to less than 35° C., and then ground to fine powder having an average particle size of about 12 microns in diameter.

The finely ground powdered hardwood carbon is admixed with the binder and sufficient water to provide a mixture having a stiff, dough-like paste form.

Fuel elements are extruded using a ram extruder from the paste so as to have 5 peripheral passageways in the form of slots or grooves, each having a depth of about 0.032 inch and a width of about 0.016 inch. The configuration of the passageways which extends longitudinally through the fuel element is shown in FIG. 1A. The resulting extrudate is dried in air to provide a resilient extrudate, and the extrudate is cut into 9 mm lengths, thereby providing fuel elements.

Substrate

A segment approximately 10 mm in length is cut from a 4.5 mm o.d. filter rod prepared from a wicking paper material, Sample No. 203032-135, available from Baumgartner Papers, S.A. A cylindrical metal rod having an o.d. of about 2 mm with a point on one end and a slot at the other end, is provided with a wicking paper, e.g., KC-1976-28-8, inserted in the slot and wrapped around the outer periphery of the metal rod to form a tube approximately 10 mm long. The pointed end of the wrapped metal rod is inserted into the filter rod and drawn down so that the edges of the tube are approximately flush with the end of the filter rod. The metal rod is then withdrawn, leaving a filter paper rod with a hollow paper tube in the center (see FIGS. 3 and 3A). The paper tube and front face of the filter rod provide the evaporative surface in this substrate.

Sleeve Assembly

The sleeve is prepared as described in Example 1.

The 10 mm long substrate (about 38 mg) is placed in the sleeve and positioned at least about 4 to 5 mm from the open (or front) end of the sleeve. Then about 100 mg of glycerin (or a mixture of glycerin and flavorants) is added to the substrate. The substrate quickly absorbs the liquid. A fuel element is inserted into the open end of the sleeve to a depth of about 2 mm. As such, the fuel element extends 7 mm beyond the open end of the sleeve and the substrate is separated from the rear of the fuel element by from about 2 to 3 mm.

Insulating Jacket

A 15 mm long, 4.5 mm diameter plastic tube is overwrapped with an insulating jacket material that is also 15 mm in length. The insulating jacket is composed of Owens Corning C-glass mat. The resulting diameter of the glass fiber jacket fuel element is about 7.5 mm. The glass jacket is wrapped with the above-described inner-wrap paper material P2574-52 which treated with about 6–8% $CaCl_2$.

Tobacco Roll

A tobacco roll consisting of volume expanded blend of Burley, Flue cured and oriental tobacco cut filler is wrapped in a paper designated as P1487-125 from Kimberly-Clark Corp., thereby forming a tobacco rod having a diameter of about 7.5 mm and a length of about 22 mm.

Frontend Assembly

The inner wrapped insulating jacket section and the tobacco rod are joined together by an overwrap of the above-referenced P2674-190 paper of the present invention which circumscribes the length of the tobacco/-glass jacket section as well as the length of the tobacco roll. P2674-190 has about 11% $CaCl_2$ incorporated into the paper and a coating comprising about 7.8% chalk, 4.3% KasilR and 1.0% CMC. The mouth end of the tobacco rod is drilled to create a longitudinal passageway therethrough of about 4.6 mm in diameter. The tip of the drill is shaped to enter and engage the plastic tube in the insulating jacket. The cartridge assembly is inserted from the front end of the combined insulating jacket and tobacco rod, simultaneously as the drill and the engaged plastic tube are withdrawn from the mouth end. The cartridge assembly is inserted until the lighting end of the fuel element is flush with the front end of the insulating jacket. The overall length of the resulting front end is about 37 mm.

Mouthend Piece

A mouthend piece includes a 20 mm long cylindrical segment of a loosely gathered tobacco paper (see FIG. 3A) and a 20 mm long cylindrical segment of a gathered web of non-woven, melt-blown polypropylene, each of which includes an outer paper wrap. (See, e.g., FIG. 3) Each of the segments are provided by subdividing rods prepared using the apparatus described in U.S. Pat. No. 4,808,809 to Pryor et al.

The first segment is about 7.5 mm in diameter, and is provided from a gathered web of tobacco paper available as P144-GNA from Kimberly-Clark Corp. which is circumscribed by a paper plug wrap available as P1487-184-2 from Kimberly-Clark Corp.

The second segment is about 7.5 mm in diameter, and is provided from a gathered web of non-woven polypropylene available as PP-100 from Kimberly-Clark Corp. which is circumscribed by a paper plug wrap available as P1487-184-2 from Kimberly-Clark Corp.

The two segments are axially aligned in an abutting end-to-end relationship, an are combined by circumscribing the length of each of the segments with a paper overwrap available as L-1377-196F from Simpson Paper Company, Vicksburg, Mich. The length of the mouthend piece is about 40 mm.

Final Assembly of Cigarette

The front end assembly is axially aligned in an abutting end-to-end relationship with the mouthend piece, such that the container end of the front end assembly is adjacent to the gathered tobacco paper segment of the mouthend piece. The front end assembly is joined to the mouthend piece by circumscribing the length of the mouthend piece and a 5 mm length of the frontend assembly adjacent the mouthend piece with tipping paper available as 30637-801-12001 from Ecusta Corporation.

Use

In use, the smoker lights the fuel element with a a cigarette lighter and the fuel element burns. The smoker inserts the mouth end of the cigarette into the mouth, and draws on the cigarette. A visible aerosol having tobacco flavor is drawn into the mouth of the smoker.

EXAMPLE 3

Booster Substrates

The substrate of Example 2 may be preceded with a booster substrate comprising a short 1 to 5 mm long segment of a 4.5 mm o.d. filter rod, prepared from wicking paper designated as Sample No. 203032-135 from Baumgartner Papers, S.A.

In cigarettes having the small (9 mm×4.5 mm) carbonaceous fuel element of Example 2, a heat conductive sleeve, and a glass fiber jacket surrounding the fuel element, impressive early aerosol deliveries (i.e., 1st, 2nd, and 3rd puffs) were obtained from cigarettes using only a 2 mm long, 4.5 mm o.d. booster substrate (loaded with glycerin at 100%) comprising a total mass (paper and glycerin) of from about 20 to 25 mg.

Another booster substrate was prepared from wicking paper, KC-1976-29-8, about 10 mg in weight, containing about 15 mg of glycerin. It was found that only 0.2 Calories was necessary to vaporize 1 mg of glycerin from this substrate and the substrate needed only 1.9 Calories to raise its temperature to 155° C. A 50 cc puff of hot air entering this booster substrate at 300° C. and exiting the booster at 155° C. generated 2.1 Calories, i.e., enough to raise the temperature of the booster and volatilize the 1 mg of glycerin. A smaller booster would require even less heat to operate efficiently.

The present invention has been described in detail, including the preferred embodiments thereof. However, it will be appreciated that those skilled in the art, upon consideration of the present disclosure, may make modifications and/or improvements on this invention and still be within the scope and spirit of this invention as set forth in the following claims.

What is claimed is:

1. A smoking article comprising:
(a) a combustible fuel element less than bout 30 mm in length prior to smoking; and
(b) a physically separate aerosol generating means disposed longitudinally behind the fuel element comprising a low mass, paper-like cellulosic substrate material having a controlled evaporative surface area, and at least one aerosol forming material; and
(c) wherein the controlled evaporative surface area ranges from about 5 $mm^2$ to about 30 $mm^2$.

2. The smoking article of claim 1, wherein the controlled evaporative surface area ranges from about 7 $mm^2$ to about 20 $mm^2$.

3. The smoking article of claim 2, wherein the controlled evaporative surface area ranges from about 9 $mm^2$ to about 15 $mm^2$.

4. A smoking article comprising:
(a) a combustible fuel element less than bout 30 mm in length prior to smoking; and
(b) a physically separate aerosol generating means disposed longitudinally behind the fuel element comprising a low mass, paper-like cellulosic substrate material having a controlled evaporative surface area, and at least one aerosol forming material; and
(c) wherein the amount of aerosol forming material contained on the substrate is at least about 100 percent by weight, based upon the dry weight of the substrate.

5. The smoking article of claim 4, wherein the amount of aerosol forming material contained on the substrate is at least about 200 percent by weight, based upon the dry weight of the substrate.

6. The smoking article of claim 5, wherein the amount of aerosol forming material contained on the substrate is at least about 300 percent by weight, based upon the dry weight of the substrate.

7. The smoking article of claim 6, wherein the amount of aerosol forming material contained on the substrate is at least about 400 percent by weight, based upon the dry weight of the substrate.

8. A smoking article comprising:
(a) a combustible fuel element less than about 30 mm in length prior to smoking;
(b) a physically separate aerosol generating means disposed longitudinally behind the fuel element comprising a low mass cellulosic substrate material having a controlled evaporative surface area, and at least one aerosol forming material;
wherein the substrate comprises two segments;
(c) an evaporative surface segment and
(d) a non-evaporative wicking segment, in contact with the evaporative segment.

9. A cigarette comprising:
(a) a carbonaceous fuel element less than about 30 mm in length prior to smoking, the fuel element having a plurality of longitudinal passageways; and
(b) a physically separate aerosol generating means including a low mass cellulosic substrate bearing an aerosol forming material;
the substrate being less than about 20 mm in length, and positioned about 6 mm or less from the rear end of the fuel element, and
comprising a tubular segment of wicking paper, with a central passageway therethrough; and
(c) wherein the substrate is located in a heat conductive sleeve, which sleeve is in contact with the rear periphery of the fuel element.

10. The cigarette of claim 9, wherein the heat conductive sleeve a metallic capsule up to about 30 mm in length.

11. A smoking article comprising:
(a) a combustible fuel element less than about 30 mm in length prior to smoking; and
(b) a physically separate aerosol generating means disposed longitudinally behind the fuel element comprising a low mass, paper-like cellulosic substrate material having a controlled evaporative surface area, and at least one aerosol forming material; and
(c) wherein the substrate comprises a tubular member having a deformed front end.

12. The smoking article of claim 11, wherein the deformation of the front end of the substrate is accomplished by crimping.

13. The smoking article of claim 11, wherein the deformation of the front end of the substrate is accomplished by forming a neck.

14. The smoking article of claim 13, wherein the neck at the front end of the substrate is an inward neck.

15. The smoking article of claim 13, wherein the neck at the front end of the substrate is an outward neck.

16. A smoking article comprising:
(a) a combustible fuel element less than about 30 mm in length prior to smoking; and
(b) a physically separate aerosol generating means disposed longitudinally behind the fuel element comprising a low mass, paper-like cellulosic substrate material having a controlled evaporative surface area, and at least one aerosol forming material; and
(c) wherein the substrate is further provided with a central passageway therethrough and includes one or more barrier members or layers to reduce the size of the evaporative surface.

* * * * *